United States Patent [19]

Hinger et al.

[11] 4,300,437

[45] Nov. 17, 1981

[54] SECTIONALIZED MUSICAL DRUMS

[75] Inventors: Fred D. Hinger, Leonia; William D. Hinger, River Vale, both of N.J.

[73] Assignee: Hinger Touch-Tone Corp., Leonia, N.J.

[21] Appl. No.: 815,405

[22] Filed: Jul. 13, 1977

[51] Int. Cl.[3] ..... G10D 13/02

[52] U.S. Cl. ..... 84/411 R; 84/421

[58] Field of Search ..... 84/411, 412, 415

[56] References Cited

U.S. PATENT DOCUMENTS

| | | | |
|---|---|---|---|
| 578,198 | 3/1897 | Boulanger | 84/411 |
| 663,854 | 12/1900 | Boulanger | 84/411 |
| 673,633 | 5/1901 | Boulanger | 84/411 R |
| 1,420,233 | 6/1922 | Baldwin et al. | 84/411 |
| 3,215,021 | 11/1965 | Kester | 84/411 R |
| 3,981,220 | 9/1976 | Clark | 84/415 |

FOREIGN PATENT DOCUMENTS

| | | | |
|---|---|---|---|
| 333081 | 8/1930 | United Kingdom | 84/412 |

*Primary Examiner*—Lawrence R. Franklin

*Attorney, Agent, or Firm*—Kenneth P. Synnestvedt

[57] ABSTRACT

The complete drum comprises two, axially-separable, generally cylindrical sections, which are open, inwardly, toward each other, each of these two sections having but one playing head, so that the two heads are disposed respectively at the outer ends of the cylindrical assembly. When the open ends of these two basic sections are axially spaced-apart to provide an annular gap between them, the space within said sections communicates with the ambient air, through said gap, substantially uniformly around the periphery of the drum. This construction, with gap, is intended to provide any desired increase in volume, and a great variety of tonal modifications.

Means are provided for adjustably varying the size of the gap, or for closing it altogether; whereby the volume, pitch, dynamics, and tonal characteristics of the drum may be varied. This may be done by using adjustable holding means, and/or by using perforate or imperforate cylindrical filler pieces.

5 Claims, 11 Drawing Figures

SECTIONALIZED MUSICAL DRUMS

BACKGROUND OF THE INVENTION

In the prior art of musical drums, it has either been known or proposed to provide multiple drums, for example: two complete double-headed drums, each substantially sealed up, relative to the surrounding atmosphere, (except for customary minor vent holes), and to mount them more or less in juxtaposition to each other, so that, when one of them is played upon, the other gives off an induced or sympathetic vibration. It has also been proposed or known to provide telescopic drums, which, in use, are substantially sealed with respect to the surrounding atmosphere, but which may be adjusted to alter the contained volume within the closed drum. Other similar telescopic drums have been proposed to be made in sections, which can be uncoupled so as to store therein smaller drums, drum sticks, and other equipment. It has further been proposed to provide a two-part drum, the two sections of which have mating edges or rims, which are hinged together at one side, like a clam-shell, the intended use being the convenient storage and/or carrying of articles inside the drum. In still another known example, i.e. the U.S. Pat. to Kester No. 3,215,021, issued Nov. 2, 1965, such a hinged drum has been suggested for the purpose of varying the sound of the drum. By actual test, however, it has been found that, with such a hinged, or other clam-shell, drum configuration, the variation in musical effect is quite limited; and whether, or to whatever extent, a change in volume may thereby be obtained, the instrument is highly unidirectional. Furthermore, the hinging of two drum parts at one side leaves much to be desired with respect to adjustability, rigidity, versatility, and general convenience of the instrument when in use.

SUMMARY OF THE INVENTION

The complete drum comprises at least two, axially-separable, circular, and generally cylindrical sections. Whether two, or more than two, sections are employed, there are two basic sections, which are open, inwardly, toward each other and preferably, each of these two sections has a playing head, so disposed that the two heads are respectively at the outer ends of the cylindrical assembly. In some embodiments, a third, but headless, generally cylindrical section is inserted between the two basic sections mentioned. When the open ends of the two basic sections are axially spaced-apart to provide an annular gap between them, the space within said sections communicates with the ambient air, through said gap, substantially uniformly around the periphery of the drum; but the axial dimension of the gap may be altered, or even closed, for example by providing holding means for adjustably varying the axial spacing between the basic sections or by the use of one or more intermediate cylindrical sections as above-mentioned, whereby the volume, pitch, dynamics, and tonal characteristics of the drum may be varied.

The adjustable holding means typically comprise a series of peripherally spaced-apart paired guides, elements of each pair being in slidable engagement, so that a set of elements fastened to one drum section slidably cooperates with a set of elements fastened to an opposing drum section, with the further feature of readily-releasable gripping means to clamp the guide elements as against relative sliding; so that said two sections may be positioned with a variety of selectable gaps, or with their facing edges in contact so as to close the gap entirely, or so that said two sections may be completely detached from one another, whereby they may be separately played, each as an open-ended drum.

Alternatively, or in conjunction with such adjustable holding means, the gap may be altered, or even eliminated, by the insertion between the two basic, opposed sections, of a headless intermediate cylindrical ring section $o_1$ of a plurality thereof which may be of differing axial dimension, respectively, and which may be imperforate, or may be wholly or partially perforate so as to give a dampened or baffled effect. The main adjustable holding means may serve to position one or more such intermediate ring sections as against radial dislodgement and/or against axial dislodgement.

The tone quality and volume of the drum are further variable by having separate head-tension-adjustment devices for the two heads, whereby chordal effects may be obtained by different pitch settings of the two heads, even though but one of the heads is being played upon.

When the drum sections are assembled with a substantial gap between them, the adjustable holding means for the sections may be utilized as a handle for carrying the instrument.

Although, as later brought out, the invention is adaptable to various musical drums, it is chiefly illustrated herein as embodied in a snare-drum; and, by using snares on one or both of the heads, still further musical effects may be obtained.

Whether utilized in snare-drums or in larger drums, for example bass drums, the invention is especially useful in marching bands or other outdoor field bands, since the provision of a uniform peripheral annular gap, around the periphery of the drum, normally increases the power of the instrument while at the same time decreasing or eliminating any unidirectional effect.

As to the intermediate, headless, section, it may further be so disposed that there are two peripheral gaps, one between it and the top section of the drum, and the other between it and the bottom section of the drum. Alternatively, the intermediate section, if held against the edge of one of the two basic sections, can be used simply to provide a difference between the effective volumes of those two sections.

DETAILED DESCRIPTION OF THE ILLUSTRATED EMBODIMENTS

Figure 1:
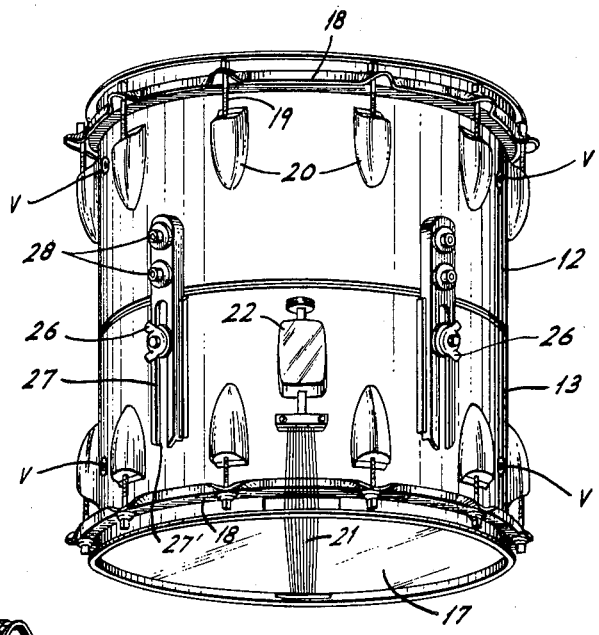
FIG. 1 is a perspective view of a drum made of two generally cylindrical sections, assembled and clamped together to form one, unified, drum assembly, which in this instance is a snare-drum, this view being taken from slightly beneath the drum, in the position illustrated, and showing adjustable means whereby said drum sections may be axially-separated, in accordance with this invention.
Figure 3:
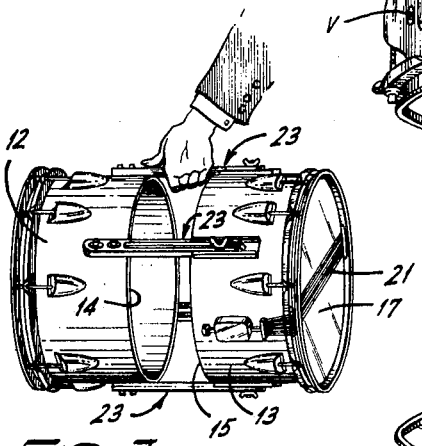
FIG. 3 is a perspective view of the drum of FIGS. 1 and 2, but to a smaller scale, showing the annular gap referred-to, the series of adjustable holding devices, in this case four in number, equispaced peripherally around the drum, and showing how one of them provides a convenient handle for carrying the instrument.
Figure 2:
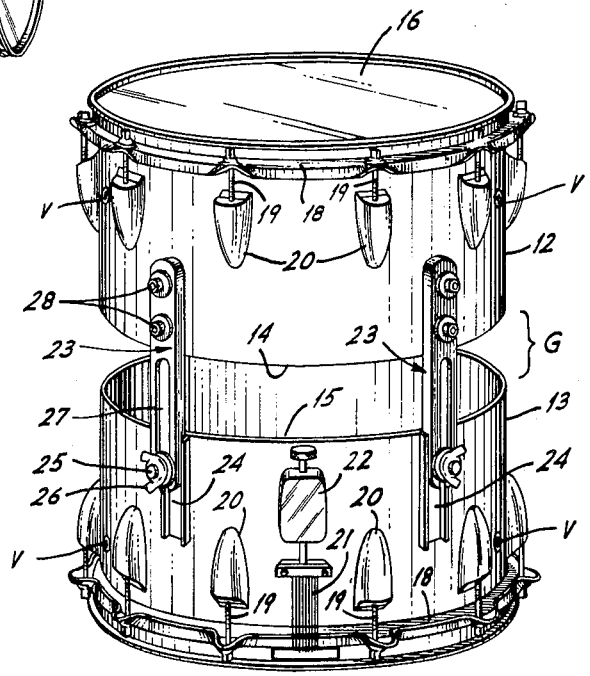
FIG. 2 is a view of the snare-drum, taken from slightly above the drum, and showing the axial separation of the two drum sections, when held and clamped in one of the selected positions of adjustment, and illustrating the annular gap around the periphery of the drum, between the facing edges of the two sections.

With reference first to FIGS. 1 to 3, it will be seen that the sectionalized musical drum there illustrated comprises an upper section 12 and a lower section 13, each of which is generally cylindrical, and the two of which are of like diameter and of like axial dimension. These two basic sections are here designated "upper" and "lower" for convenience, since the drum may of course be carried and/or played in various positions. Each of these sections is open at the end which faces toward the other as is clearly seen in FIGS. 2 and 3; and their circular, facing, edges 14 and 15 will register and seat against one another when the two sections are brought together as shown in FIG. 1.

Each section has its outermost end covered by a drum head, the upper head 16 being shown in FIG. 2 and the lower head 17 being shown in FIGS. 1 and 3. The heads may be of hide, or of plastic, or other suitable material. The heads may have similar or identical tightening ring assemblies, generally indicated at 18,18, which are adjustably tensioned each by a peripheral series of tuning screws 19,19, threaded into fixed brackets 20,20. When the sections 12 and 13 are held together, as in FIG. 1, the assembly is a normal "closed" drum, i.e. one which has just the customary, small, vent ports V,V, but when the sections are axially spaced-apart, as in FIGS. 2 and 3, there is an appreciable annular gap G, which is substantially uniform around the periphery of the drum.

Although the invention is applicable to many different types and many different sizes of musical drums, it is herein illustrated chiefly as applied to a snare-drum, and it will be seen from certain figures of the drawings that a snare device 21 is associated with the playing head 17 of the lower drum section 13; the snare being variably tensioned by means of any suitable, known, snare adjuster 22.

A holding and adjustment system for the sectionalized drum is designated generally by the numerals 23,23. This holding and adjustment system, which typically comprises four adjustment and clamping assemblies 23, preferably equi-spaced around the periphery of the drum (as seen in FIG. 3) serves a number of functions: First, this holding system acts to secure the drum sections together, when in use as one drum assembly; second, this system provides a simple release means, so that the sections may be completely detached from one another, whereby each end section may be separately played, each as an open-end drum; third, this system provides ready adjustability of the axial spacing between drum sections, so as to vary the size of the gap G between them, to any selected value, or to close the gap entirely; fourth, it provides for the ready insertion, retention, removal, and replacement, of one or more, like or different, intermediate headless cylindrical drum sections, which may act in various ways, such as to alter the internal drum volume, to alter the effective length of one end drum section relative to the other, to alter the effective peripheral gap around the drum, and to serve in whole or in part as, or to carry, a damper or baffle, wholly or partially of perforate formation, for example like the screening of a speaker system; and fifth, this holding system provides convenient handle means for carrying the drum assembly.

Each adjustment and clamping assembly 23 include paired guide elements, two elements of each pair being in slidable engagement. Thus, one set of elements comprises the brackets 24, fixed to one drum section—in this case the bottom section, as seen in FIG. 2. Each bracket 24 (here four in number) carries a fixed threaded stud 25 with a wing-nut 26. The cooperative set of elements comprises slotted guide elements 27, each fixed by bolts or the like 28 to the other end drum section (in this case the uppermost section) as best seen in FIG. 1. Each such element 27 is substantially elongated, in the axial direction of the drum assembly, and the lower end of the slot of such element is open as shown at 27', so that the elements 27 may be slid on or off of the studs 25, may ride upon the fixed guide elements 24, and may be clamped or gripped in any selected position of adjustment, by means of the wing-nuts 26. Thus, the two-section drum assembly shown in FIGS. 1 to 3, may be held with the drum sections 12 and 13 in engagement (as in FIG. 1) or with a maximum gap G between them (as in FIGS. 2 and 3), or in any selected intermediate position of adjustment; or the said two sections 12 and 13 may be completely detached from one another, whereby they may be separately played, each as an open-ended drum.

Figure 4:
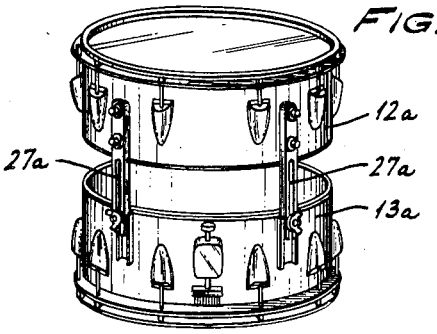
FIG. 4 is a view similar to FIG. 2, but showing a modified form of drum, in which the two drum sections are of lesser axial dimension than those in the embodiments of FIGS. 1 to 3.
Figure 8:
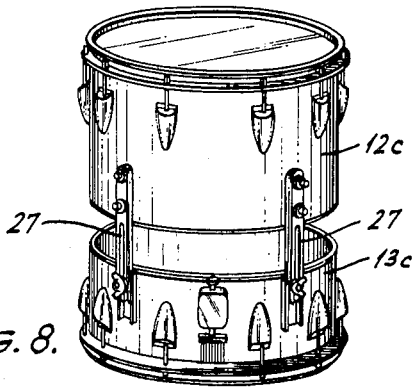
FIG. 8 is a view generally similar to FIGS. 2, 4 and 5, illustrating another embodiment wherein the two basic sections of the drum are of unequal axial dimension.
Figure 5:
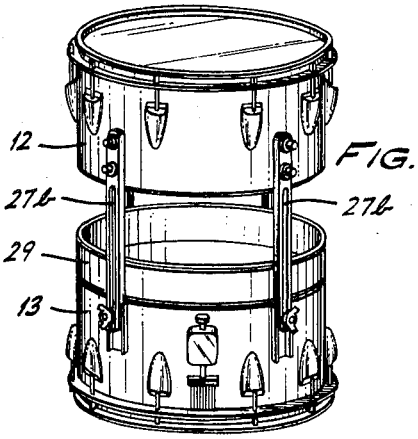
FIG. 5 is a view similar to FIG. 2, but showing a third embodiment, in which the clampable guides for holding the two basic drum sections together are longer than those of the embodiments of FIG. 1 to 3, whereby a larger peripheral gap between the two basic drum sections is obtained, in which gap is a third drum section which is cylindrical but headless.
Figure 9:
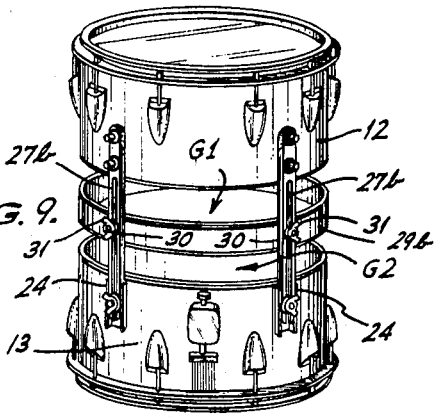
FIG. 9 is a view generally similar to FIGS. 2, 4, 5, 6 and 8 showing equal main drum sections as in the embodiments of FIGS. 1 to 6, but illustrating a narrower intermediate section than those shown in FIGS. 5 and 6, which section is here supplied with studs and wing-nuts like those shown in FIG. 7, this FIG. 9 being also arranged to show the intermediate section spaced from both of the basic sections, so as to provide two peripheral gaps.
Figure 6:
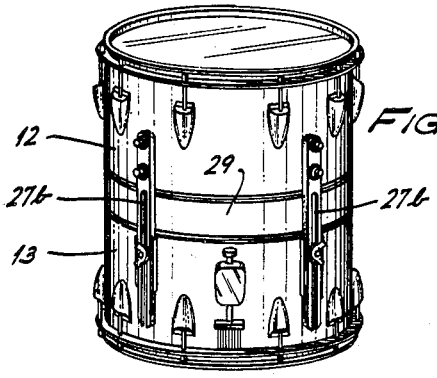
FIG. 6 is a view of the embodiment of FIG. 5 but illustrating the drum in a normal closed condition.

Essentially the same mechanism for adjusting and holding the relative positions of the uppermost and lowermost drum sections, and for detaching said sections, may be utilized in the modified embodiments shown in FIGS. 4, 5, 6, 8, 9 and 11; and that mechanism is shown in most of those Figures; although the length of the slotted guide elements is different in certain of those embodiments, for example: the slotted elements 27*a* shown in FIG. 4 are shorter than those seen at 27 in the first embodiment; and the slotted guide elements 27*b* shown in FIGS. 5, 6, and 9 are longer than the elements 27 of the first embodiment. It will be clear that the elements 27*a* in FIG. 4 may be shorter because the drum sections 12*a* and 13*a* are of lesser axial dimension than the drum sections 12 and 13 of FIGS. 1 to 3.

In FIG. 8, even though the upper drum section 12*c* is of substantially greater axial dimension than that of the lower section 13*c*, the slotted guide elements 27 may be similar in length to those shown in FIGS. 1 to 3, since the overall total axial length of the drum assembly is similar to that of FIGS. 1 to 3.

In FIGS. 5 and 6, although the basic drum sections 12 and 13 may be of similar size to those shown in FIGS. 1 to 3, the slotted guide elements 27*b* are preferably made considerably longer, so as to accommodate one or more (or various alternative) intermediate headless cylindrical drum sections. Such a section is shown at 29. It simply seats upon the upper edge of the lowermost drum section 13. It is held as against radial dislodgement, by being trapped within the four slotted guide elements 27*b*. In effect, this drum section 29, when assembled as in FIG. 5, increases the axial depth of the lowermost section, as compared with the uppermost section, so that this drum assembly is more or less the reverse of the assembly shown in FIG. 8. The size of the peripheral gap between the sections 12 and 29 may be varied by adjusting the holding mechanism, just as is the case with the embodiment of FIGS. 1 to 3; or the gap may be closed entirely, by collapsing the sections to the position shown in FIG. 6.

Figure 10:
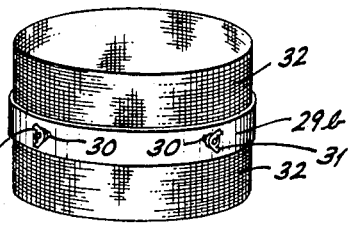
FIG. 10 is a detailed view of a modified intermediate drum section, wherein said section is partially of solid wall construction, as in FIG. 9, but has perforated of screenlike upper and lower extensions, which may serve as partial baffles when disposed within the peripheral gaps shown in FIG. 9.
Figure 7:
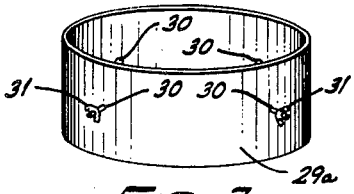
FIG. 7 is a detailed view of a modified intermediate headless ring section, which is of greater axial dimension than that shown in FIGS. 5 and 6, and which also embodies studs and wing-nuts, adapted for cooperation with the guides shown in FIGS. 5 and 6.

FIGS. 7, 9, and 10 show several other forms of intermediate drum sections, adaptable for use in drum assemblies such as shown in FIGS. 1 to 3, FIG. 4, FIGS. 5 and 6, and FIG. 8. Thus, in FIG. 7, a solid intermediate drum section 29*a* is shown which is of considerably larger axial dimension than section 29 just described. Furthermore, this section 29*a* carries four studs 30 and four wing-nuts 31. These are so positioned that when the section 29*a* is incorporated in an assembly such as that of FIGS. 5 and 6, the studs 30 (FIG. 7) are slidable within the slotted guide elements 27*b*, and may be locked thereto at various axial positions, by means of the wing-nuts 31. Thus the holding means for the basic units 12 and 13 (of FIGS. 5 and 6) will position the central cylindrical drum section, not only radially, but also in various selectable positions axially of the assembly. This can readily be seen from FIG. 9, wherein a very narrow intermediate section 29*b* is employed, and, in this instance, is locked in an intermediate position between the drum sections 12 and 13, so as to leave two peripheral gaps G1 and G2.

In FIG. 10 an intermediate section 29*b*, like that shown in FIG. 9, is provided with foraminous cylindrical screening 32, above and below, which is adapted to fit within the drum sections 12 and 13, and to provide a damping effect or other sound modification.

Figure 11:
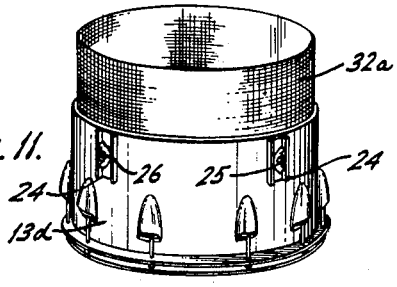
FIG. 11 is a modified structure, comprising a lowermost basic section having no snares, which section may take the place of the lowermost drum section in any of the embodiments of FIGS. 1 to 6, 8 and 9, and carrying a normally-fixed cylindrical screen, which may be a speaker-type grill, adapted to be partially or wholly telescoped within an uppermost drum section.

In FIG. 11, the modification comprises a lowermost drum section 13*d* which is provided with the normal head tighteners, like those of the bottom section 13 of the embodiment of FIGS. 1 to 3, but this embodiment has no snare mechanism. This bottom section 13*d* may carry a cylindrical screen element 32*a*, adapted to fit within, and cooperate with, any of the uppermost drum sections 12, 12*a*, or 12*c*.

It should be pointed out that this invention is well adapted to utilize various known, and widely available drum parts, and drum materials. Thus, the basic drum sections and/or the intermediate cylindrical ring section or sections may be of various standard diameters, and may be made of regularly known and accepted materials, such as wood, fibre, metal, plastic or other material, either solid, laminated, or molded. Similarly the heads may be of known types, such as hides, plastics, or other generally acceptable materials; and the adjustment of the heads may be by normal hoop or ring constructions, having normal or standard, adjustable, tightening devices, for holding said heads in position and for tuning them. In the embodiments utilizing snares, these may be of known construction with known adjustment devices, if desired. Although not shown in all figures of the drawings, the usual, small, vent ports V,V, shown for example in FIGS. 1 and 2, can, and normally are, utilized in all of the drums illustrated herein.

In the simplest possible form of mechanism embodying the invention, a pair of basic end-drum sections, each with only one head, and with the two sections having their open ends facing each other (as in FIG. 2) are provided with means fixedly holding them in axially-spaced-apart relation, so that an appreciable gap G is provided, extending substantially completely around the periphery of the drum, and of substantially uniform width around said periphery. When sticks or mallets beat upon either of the heads of such an assembly, there is a very substantial increase in volume of sound produced by the drum, especially when the two sections are equal in size and their heads are tuned to the same pitch; and the sound is projected substantially uniformly in all radial directions, which is of material advantage, especially when the drum is used in marching bands.

As heretofore indicated, in the summary of the invention, certain special advantages are associated with other forms of the invention, or flow from various of the structural and functional features of the different embodiments of the invention. For example: the utilization of basic drum sections of differing axial dimensions, such as shown at 12*c* and 13*c* in FIG. 8, or the alternative utilization of end drum sections with one of which is associated a supplemental annular section (as shown at 29 in FIG. 5), enables the player to readily obtain combined harmonic or dissonant effects—again with substantial volume and with substantially uniform projection peripherally of the drum. Furthermore, such embodiments can be utilized to obtain a predominance of tone at one pitch from one of the end-drum sections, as compared with the tone, at a different pitch, from the other end-drum section.

Chordal effects may also be obtained from symmetrical drums such as shown in FIGS. 2, 4 and 9, if the two drum heads, in any of said embodiments, are differently tuned.

The adjustable mechanism for assembling, disassemblying, and variously positioning, the basic drum sections, as well as various intermediate sections, is of a very simple and sturdy construction, easily tightened or loosened, and very stable when the drum is in use.

The intermediate, headless, cylindrical sections render the assembly very versatile, for example, by providing for multiple gaps, G1 and G2, or for a single gap; also for wholly or partially closing the gap area, either by bringing all parts together, as in FIG. 6, or by variously opening a gap or gaps, and/or providing damping effects, such as by the screening shown in FIG. 10. The latter effect may also be obtainable by combining the head of FIG. 11 with one or another of the other basic heads.

In view of the foregoing description, other advantages of the invention will appear to those skilled in the art of playing on percussion instruments.

In conclusion, it is intended that the entire disclosure be considered as illustrative, and as limited only by the claims, and that the latter be construed as broadly as permitted by the prior art.

We claim:

1. A sectionalized musical drum comprising two generally cylindrical sections of substantial axial dimension, adjustably movable, in the axial direction, relative to each other, so as to provide at will an annular gap between them which is substantially uniform around the periphery of the drum, each of said cylindrical sections being of substantial volume and open at the end which faces toward the other, and each of said sections having its outermost end covered by a drum head, and means for holding said two generally cylindrical sections fixedly in any selected relative position as against dislocation by the beating of the player upon either of said heads; and further having foraminous sound-permeable screening material positioned to cover said gap.

2. A sectionalized musical drum comprising two separate drum body members, each having a body wall of generally circular cross-sectional contour positioned on a common axis, said body members being open at their ends presented toward each other and each having a generally circular edge confronting that of the other, the two body members being adjustably shiftable toward and away from each other along said common axis to define a variable peripheral open gap providing intercommunication between the interior of both of the body members and the ambient air, each of said body members having its outer end substantially enclosed, at least one of them being enclosed by a drum head adapted to be beaten upon, and mechanism for mounting and interconnecting said body members in position on said common axis comprising a plurality of connection elements at angularly spaced points about the body members, each of said connection elements being connected with the wall of one of the body members and having a portion extended beyond the confronting edges of the body members to overly the wall of the other body member, the extended portion of each connection element being movable to different positions with respect to the wall of said other body member when the two members are adjustably shifted along said common axis, and said mounting and interconnecting mechanism further including fastening means connected with the wall of said other body member for engaging and securing the extended portion of each connection element in any adjustably shifted position with respect to the wall of said other body member, and said fastening means including a releasable and engageable device accessible externally of the body members providing for release and engagement of the fastening means regardless of the adjusted positions of the drum body members, the drum further including a removable and replaceable body member intermediate the two body members first mentioned and having a body wall with both ends open and with circular edges both confronting the circular edges of the two body members first mentioned with a peripheral gap between the intermediate body member and at least one of the body members first mentioned, and the extended portion of each connection element being of sufficient length to span the intermediate body member and thereby provide for mounting and interconnecting the body members whether or not the intermediate body member is present.

3. A sectionalized musical drum comprising two separate drum sections, each having a body wall of generally circular cross-sectional contour, positioned on a common axis, each of said drum sections having its outer end substantially enclosed and at least one of them being enclosed by a drum head adapted to be beaten upon, said drum sections being open at their ends presented toward each other and each having a generally circular edge confronting that of the other, the two drum sections being relatively shiftable toward and away from each other along said common axis to define a variable peripheral open gap between said edges providing intercommunication between the interior of both of the drum sections and the ambient air, the drum sections also being shiftable toward each other to bring said circular edges into engagement with each other and thereby close said gap and thus preclude intercommunication between the interior of the drum and the ambient air, and mechanism for mounting and interconnecting said drum sections in position on said common axis comprising a plurality of connection elements at angularly spaced points about the drum sections, each of said connection elements being elongated and being connected with the wall of one of the sections and projecting beyond the confronting edges of the sections to overlie the wall of the other section with said circular confronting edges of the sections either in engagement with each other or spaced from each other, the projecting portion of each connection element being movable to different positions with respect to the wall of said other section when the two sections are relatively shifted along said common axis, and said mounting and interconnecting mechanism further including fastening means connected with the wall of said other drum section and cooperating with the projecting portion of one of said elements for engaging and securing the said portion in any relatively shifted position with respect to the wall of said other drum section, the fastening means comprising a releasable and engageable device accessible externally of the drum sections providing for release and engagement of the fastening means either when the drum sections are positioned with said confronting edges in engagement with each other or alternatively when the drum sections are spaced from each other.

4. A drum as defined in claim 3 in which the projecting portion of each elongated connection element is slotted and in which the fastening means for each element projects through the slot of that element.

5. A drum as defined in claim 4 in which the slot of each connection element is open at the end of the element projecting in overlying relation to said other drum section, and further in which said projecting portion of each of said elements and the associated fastening means may be relatively separated through the open end of the slot.

* * * * *